United States Patent [19]

Oshikubo

[11] 4,141,251

[45] Feb. 27, 1979

[54] PIPETTING DEVICE

[75] Inventor: Yuji Oshikubo, Sakura, Japan

[73] Assignee: Nichiryo Co., Ltd., Tokyo, Japan

[21] Appl. No.: 877,879

[22] Filed: Feb. 15, 1978

[51] Int. Cl.[2] ..... B01L 3/02

[52] U.S. Cl. ..... 73/425.6; 222/309

[58] Field of Search ..... 73/425.4 P, 425.6; 222/309, 326, 327

[56] References Cited

U.S. PATENT DOCUMENTS

| | | | |
|---|---|---|---|
| 3,327,900 | 6/1967 | Goda | 222/309 |
| 3,613,952 | 10/1971 | Gilmont | 73/425.6 |
| 3,766,784 | 10/1973 | Walker | 73/425.4 P |
| 3,810,391 | 5/1974 | Souvaniemi | 73/425.6 |

*Primary Examiner*—S. Clement Swisher

*Attorney, Agent, or Firm*—James E. Nilles

[57] ABSTRACT

A pipetting device including a cylinder disposed at the lower end portion of a cylindrical housing, a piston working in the cylinder and having a piston rod secured thereto to extend through the housing, an actuating knob secured to the upper end of the piston rod, and a return spring biassing the piston rod upwardly, wherein the device further comprises a sleeve fitted screw-threadingly in the housing and engaging with the piston rod slidably but non rotatably, locking means releasably preventing rotation of the sleeve in the housing, an elongated transparent window having a scale thereon and being formed in the housing, and a datum line formed around the outer periphery of the sleeve.

6 Claims, 7 Drawing Figures

PIPETTING DEVICE

BACKGROUND OF THE INVENTION

This invention relates to improvement in pipetting devices.

Many proposals have been made to provide pipetting devices of various constructions which can be used conveniently to transfer a desired amount of liquid samples rapidly and accurately. Examples of devices of this type can be found in U.S. Pat. Nos. 2,798,647, 3,494,201, 3,810,391, 3,827,305, and 3,855,867. Typically, such pipetting devices includes a cylinder disposed at the lower end portion of a tubular housing coaxially therewith, a piston reciprocably fitted in the cylinder and having an actuating rod connected thereto to extend coaxially in the tubular housing, an actuating knob secured to the upper end of the actuating rod, a discharge nozzle connected to the lower end of the cylinder, and a return spring biasing the actuating rod or the piston in the upward direction. Naturally, there is disposed, further, means for adjusting the stroke of the piston and means for indicating the amount of liquid dischargeable in respective adjusted conditions.

However, there are shortcomings in prior art pipetting devices such that the construction of piston stroke adjusting means and/or indicating means is complicated very much so that the adjusting procedure is troublesome and time consuming and the manufacturing cost is expensive, and that accurate adjustment can not be achieved as in the case when graduations are marked on the wall of the glass cylinder and the sealing surface of the piston serves as the datum line, and that the pipetting device can not be used in two appliances, namely, one for sucking a liquid sample from one container, moving the device upon the other container and discharging the sample into the other container, and one for sucking a liquid sample from one container located at a position remote from the device and discharging the sample without moving the device.

BRIEF SUMMARY OF THE INVENTION

It is a primary object of the present invention to provide a hand-held pipetting device enabling quick and accurate adjustment.

According to the present invention, there provided a pipetting device of the aforementioned type further comprises a sleeve being rotatably and axially movably in the housing by the screw-thread engagement therebetween, key and key way means disposed between the actuating rod and the sleeve for preventing relative rotation therebetween but allowing relative sliding movement, locking means for releasably preventing the rotation of the sleeve relative to the housing, an elongated transparent window formed in the housing to extend in the direction of the axis thereof, a scale disposed in the window, and a datum line formed around the outer periphery of the sleeve to cooperate with the scale.

Thus, the adjustment can be effected very simply and quickly by rotating the actuating rod with respect to the housing with locking means being released.

It is another object of the present invention to provide a pipetting device having a simple and sturdy construction thus reducing manufacturing costs.

It is further object of the present invention to provide a pipetting device which can be used with a generally conical-shaped tapered nozzle usually called as a tip for sucking and discharging liquid samples through an opening formed in the tip end of the nozzle and also used, alternatively, with a suction and discharge device defining a space therein which is connected through a check valve to a suction pipe and also is connected through another check valve to a discharge nozzle.

These and other objects of the present invention will be apparent from the following description taken in conjunction with reference to the drawings which are illustrative of preferred embodiments of the present invention.

Figure 2:
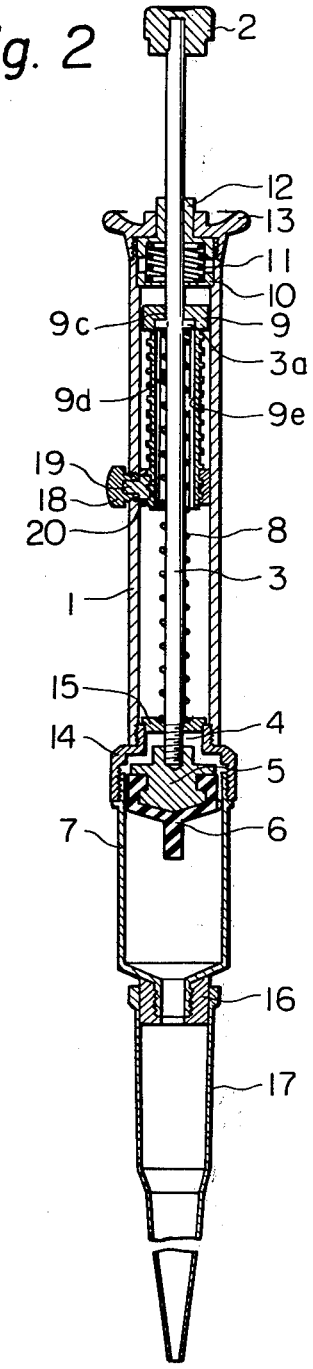
FIG. 2 is a cross-sectional view of the pipetting device of FIG. 1 but having a disposal tip connected to the lower end of the cylinder.

Referring particularly to FIG. 2, there is shown a pipetting device according to the present invention comprising a tubular housing 1 formed preferably of metal tube such as an aluminum alloy, a cylinder 7 connected to the lower end of the housing 1 through a connector 14, a piston 5 having a seal 6 thereon and working in the cylinder 7, and an actuating rod 3 the lower end of which engaging screw-threadingly with the piston 5 and secured by means of a lock nut 4 and the upper end of which carries an actuating knob 2. In the embodiment, the upper end portion of the rod 3 is formed to have a cutout portion in the outer circumference and a correspondingly shaped bore is formed in the knob 2 to receive the cutout portion and a set screw (not shown) secures the knob 2 on the rod 3.

A pair of keys 3*a* is formed integrally on the actuating rod 3 to project diametrically opposite directions. A return spring 8 extends between the keys 3*a* and a spring retainer 15 supported on a connector 14 to bias the actuating rod 3 and the piston 5 upwardly. There is provided a sleeve 9 having a cylindrical portion 9*a* at the upper end portion thereof for rotatably and slidably received in the housing 1 and a reduced diameter portion having male screw threads 9*b* thereon extending downward from the cylindrical portion 9*a*. The screw threads 9*b* engages with a retaining nut 20 secured in the housing 1. A small diameter bore 9*c* receiving the actuating rod slidably is formed in the upper end portion of the sleeve 9 and is connected with a large diameter bore 9*d* formed in the substantial portion of the length of the sleeve to receive freely the return spring 8 around the periphery of the rod 3. Further, key ways 9*e* are formed in the bore 9*d* to receive slidably the keys 3*a*.

A radial bore is formed in the retaining nut 20 to receive an abutting member 19 slidably, and a lock nut 18 is screw-threadingly engages with the housing 1 to releasably urge the abutting member 19 against the sleeve 9.

The upper end of the housing 1 is closed by a cap 13 and the upper end of an overtravel knob 12 having a generally sleeve-like form projects normally from the upper end of the cap 13 as shown in the drawing by a coil spring 11 having the spring rate much higher than the return spring 8. The lower end of the spring 11 is received by a retainer 10.

A generally conical shaped nozzle or tip 17 is, in the embodiment of FIG. 2, connected to the lower end of the cylinder 7 through a holder 16. The outer circumference of the holder 16 is taperd in the downward direction so as to engage releasably with the tip 17.

In operation, the piston 5 is moved downward by pushing the knob 2 from its normal rest position shown in the drawing so as to abut with the overtravel knob 12. When, in its position, the lower end of the tip 17 is immersed in a liquid the knob 2 is released. The piston 5 returns slowly to its normal rest position by the return spring 8 and thereby to draw liquid into the tip 17. The volume of liquid drawn into the tip 17 is related directly to the volume of fluid displaced within the cylinder. Then, the pipetting device is positioned over another container and the liquid is discharged from the tip by depressing the knob 2. When the knob 2 abuts with the overtravel knob 12, some amount of liquid usually remains in the tip. By depressing the knob 2 further beyond a point of a sudden increase in resistance to compress the relatively hard spring 11 additionally it is possible to discharge the liquid in the tip 17 completely.

Figure 1:
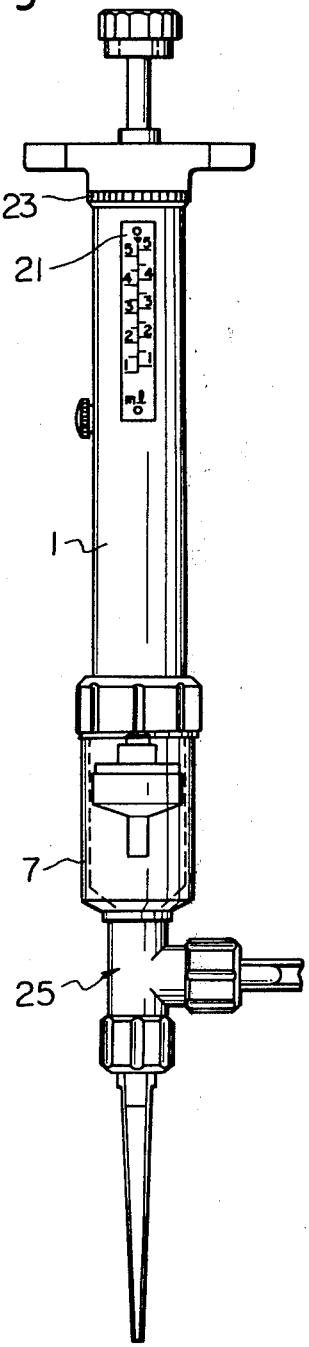
FIG. 1 is a side view of a pipetting device according to the present invention with a suction and discharge device being attached to the lower end of the cylinder.
Figure 5A:
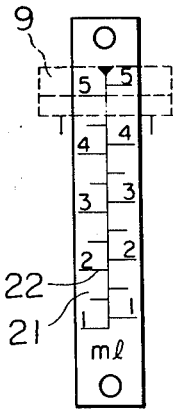
FIG. 5*a* is an enlarged front view of the scale portion of FIG. 1.

In adjusting the amount of liquid sucked by reciprocating the piston 5, the lock nut 18 is released and the knob 2 is rotated by finger to rotate the sleeve 9 relative to the housing, and the sleeve 9 moves upward or downward in the housing carrying the rod 3 and the piston 5 therewith. When the sleeve 9 reaches at a desired position the lock nut 18 is tightened. To indicate the adjusted position of the sleeve 9, an elongated transparent window 21 having scale 23 thereon is disposed on the housing 1 as shown in FIGS. 1 and 5*a*, and the datum line 9*f* is formed around the outer periphery of the cylindrical portion of the sleeve 9. Thus the adjustment and reading of the scale can be effected accurately and reliably.

Figure 3:
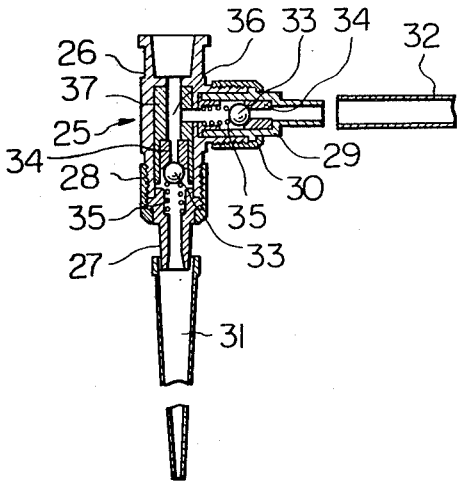
FIG. 3 is the cross-sectional view of the suction and discharge device shown in FIG. 1.

In FIG. 1, the lower end of the cylinder 7 is detachably connected to a sucking and discharging means designated generally by reference numeral 25 and the construction of which is shown in FIG. 3.

As shown in FIG. 3, sucking and discharging means 25 comprises a generally T-shaped main body 26 defining a space 36 therein, an outlet holder 27 connected to the lower end of the main body 26 by a screw cap 28, an inlet holder 29 connected to generally horizontally extending arm of the main body 26 by a screw cap 30, a discharging tip 31 connected releasably to the lower end of the outlet holder 27, an inlet tube 32 connected to the inlet holder 29, and valve balls 33 being urged normally against respective valve seats 34 by coil springs 35 to intercept the communication between the space 36 and the inlet pipe 32 or the discharging tip 31. The valve balls 33 and the valve seats 34 cooperate to constitute inlet and outlet check valves allowing flow of fluid from the inlet tube 32 to the discharging tip 31 and prevent the flow in the reverse direction. Shown at 37 is a spacer locating the valve seat 34 of the discharging check valve.

The upper end of the main body 26 is adapted to be connected releasably to the holder 16 illustrated in FIG. 2.

Figure 4:
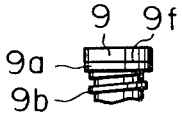
FIG. 4 is a partial side view of the sleeve shown in FIG. 2.
Figure 6:
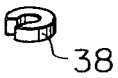
FIG. 6 is a perspective view of a detachable collar.
Figure 5B:
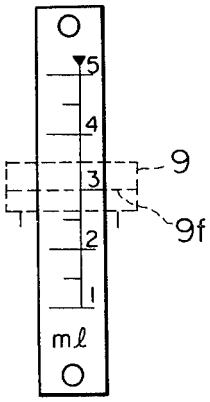
FIG. 5*b* is a view similar to FIG. 5 showing a modified form.

In operating the device of FIGS. 1 and 4, the free end of the inlet tube 32 is immersed into liquid contained in such as a bottle of liquid sample. Preferably a suitable weight is attached to the free end of the inlet tube so that the free end of the inlet tube does not project incidentally from the liquid in the bottle. By actuating the rod 3 repeatedly liquid in the bottle will be sucked through the inlet tube 32 and fills the interior of the device (the space 36, the interior of the cylinder defined below the piston 5 and, preferably, the interior of the tip 31). In such operation the check valves 33, 33 act to prevent air from being sucked through the tip 31, and the small opening formed in the end of the tip 31 enables the interior of the tip being filled with liquid sample. By adjusting the position of the sleeve 9, it is possible to transfer a predetermined amount of liquid from the bottle to another container located below the tip 31 each times when the piston 5 is reciprocated in the cylinder. In this arrangement, it has been found that the amount of liquid being sucked into the cylinder in raising the actuating rod differs from the amount of liquid in the first case at the same travel of the piston since air is included in the cylinder in the first case while the interior of the cylinder is filled with liquid in this case. For this end, the scale 21 according to the present invention bears two sets of scales as shown in FIG. 5*a*. But the scale 21 may be formed to have a single set of scales as shown in FIG. 5*b* when the device is designed specially for a single purpose. Further, when the device is designed specially with the sucking and discharging means 25, the overtravel mechanism 11, 13 may be omitted, since a predetermined amount of liquid may be discharged from the tip 31 by a predetermined downward stroke of the piston precisely. Under similar reasons it is preferable to provide a detachable collar 38 (FIG. 6) around the projecting portion of the overtravel knob 12 so as to engage with the actuating knob 2 to restrict the downward movement of the actuating knob whereby the function of the overtravel knob is nulified. The collar 38 may be substituted by locking means of any desired form such as a set screw releasably engaging with the overtravel knob 12.

As described heretofore in detail, the pipetting device according to the present invention is very simple and sturdy in construction, very easy in setting accurately the amount of liquid being discharged which can be effected by rotating the actuating rod with the locking means 18, 19 being released, and having versatile usages.

What is claimed is:

1. A pipetting device including a cylinder disposed at the lower end portion of a tubular housing coaxially therewith, a piston reciprocably fitted in the cylinder and having an actuating rod secured thereto to extend coaxially in the tubular housing, an actuating knob secured to the upper end of the actuating rod, a discharge nozzle connected to the lower end of the cylinder, and a return spring biasing the actuating rod in the upward direction, wherein the device further comprises a sleeve having a cylindrical portion on the upper end portion thereof for slideably and rotatably engaging with the inner periphery of the housing and a screw-threaded portion for engaging with a screw-threaded portion formed on the inner periphery of the housing, key and key way means disposed between the actuating rod and the sleeve for preventing relative rotation between the sleeve and the actuating rod but allowing relative sliding movement therebetween, whereby manual rotation of said actuating rod effects rotation and axial adjustment of said sleeve and of said actuating rod, locking means for releasably preventing the rotation of the sleeve relative to the housing, an elongated transparent window formed in the housing and extending in the direction of the axis thereof, a scale disposed in the window, and a datum line formed around the outer periphery of the sleeve and visible through said window.

2. A pipetting device as set forth in claim 1 wherein, the discharge nozzle is a generally conically tapered nozzle having an opening in the tip end thereof for sucking and discharging liquid samples therethrough.

3. A pipetting device as set forth in claim 1 wherein the device further comprises an overtravel sleeve slidably surrounding the actuating rod and being biassed upwardly by a spring separate from the return spring so that the upper end of the overtravel sleeve projects normally from the upper end of the housing to engage with the actuating knob in the downward movement of the actuating rod.

4. A pipetting device as set forth in claim 1 wherein the lower end of the cylinder is connected to suction and discharge means defining therein a space which is connected to a suction pipe through a check valve and also is connected to a discharge nozzle through another check valve.

5. A pipetting device including a cylinder disposed at the lower end portion of a tubular housing coaxially therewith, a piston reciprocably fitted in the cylinder and having an actuating rod secured thereto to extend coaxially in the tubular housing, an actuating knob secured to the upper end of the actuating rod, a discharge nozzle connected to the lower end of the cylinder, and a return spring biasing the actuating rod in the upward direction, wherein the device further comprises a sleeve being rotatably and axially movably disposed in the housing by the screw-thread engagement therebetween, key and key way means disposed between the actuating rod and the sleeve for preventing relative rotation between the sleeve and the actuating rod but allowing relative sliding movement therebetween, locking means for releasably preventing the rotation of the sleeve relative to the housing, an elongated transparent window formed in the housing and extending in the direction of the axis thereof, a scale disposed in the window and having two sets of graduations, and datum line formed around the outer periphery of the sleeve; connecting means defining a tapered outer circumference secured to the lower end of said cylinder; and either of a generally conically tapered nozzle for sucking and discharging liquid samples and suction and discharge means defining therein a space being connected to a suction pipe through a check valve and also to a discharge nozzle through another check valve is selectively and detachably connected to the lower end of said cylinder through said connecting means.

6. A pipetting device including a cylinder disposed at the lower end portion of a tubular housing coaxially therewith, a piston reciprocably fitted in the cylinder and having an actuating rod secured thereto to extend coaxially in the tubular housing, an actuating knob secured to the upper end of the actuating rod, a discharge nozzle connected to the lower end of the cylinder, and a return spring biasing the actuating rod in the upward direction, wherein the device further comprises a sleeve being rotatably and axially movably disposed in the housing by the screw-thread engagement therebetween, key and key way means disposed between the actuating rod and the sleeve for preventing relative rotation between the sleeve and the actuating rod but allowing relative sliding movement therebetween, locking means for releasably preventing the rotation of the sleeve relative to the housing, an elongated transparent window formed in the housing and extending in the direction of the axis thereof, a scale disposed in the window, a datum line formed around the outer periphery of the sleeve; an overtravel sleeve surrounding slideably the actuating rod and being biassed upwardly by a spring separate from the return spring so that the upper end of said sleeve projects normally from the upper end of the housing to engage with the actuating knob in the downward movement of the actuating rod; and means for releasably preventing downward movement of the overtravel sleeve.

* * * * *